US006422277B1

(12) United States Patent
Kube et al.

(10) Patent No.: US 6,422,277 B1
(45) Date of Patent: Jul. 23, 2002

(54) FEED ROLLS WITH REPLACEABLE FLUTE ELEMENTS

(75) Inventors: Burk R. Kube, Langley (CA); Marek S. Cholewczynski, Bothell, WA (US)

(73) Assignee: Nicholson Manufacturing Company, Seattle, WA (US)

( * ) Notice: Subject to any disclaimer, the term of this patent is extended or adjusted under 35 U.S.C. 154(b) by 0 days.

(21) Appl. No.: 09/898,530

(22) Filed: Jul. 2, 2001

Related U.S. Application Data

(63) Continuation of application No. 09/656,500, filed on Sep. 7, 2000, now Pat. No. 6,253,813.

(51) Int. Cl.[7] ..... B27C 5/02

(52) U.S. Cl. ..... 144/246.1; 144/248.5; 144/250.1; 492/30; 492/60

(58) Field of Search ..... 144/242.1, 246.1, 144/248.5, 250.1, 248.7; 492/30, 33–36, 60

(56) References Cited

U.S. PATENT DOCUMENTS

| | | | | |
|---|---|---|---|---|
| 3,833,162 A | | 9/1974 | Sato | |
| 4,385,650 A | * | 5/1983 | Schmidt | 144/248.5 X |
| 4,721,139 A | | 1/1988 | Peterson et al. | 144/248.7 |
| 5,152,328 A | * | 10/1992 | Arvidsson | 144/248.7 X |
| 5,944,078 A | | 8/1999 | Lindholm | 144/248.5 |

FOREIGN PATENT DOCUMENTS

EP 1 101 581 A2 5/2001

* cited by examiner

*Primary Examiner*—W. Donald Bray
(74) *Attorney, Agent, or Firm*—Seed Intellectual Property Law Group PLLC

(57) ABSTRACT

A fluted feed roll has inner replaceable flute inserts which abut and are bolted to anchor pieces welded in place on a cylindrical roll body. Part of the inner longitudinal edge of the flute inserts bears directly against the surface of the roll body. Traction elements on the outer longitudinal edge of the flute inserts protrude radially outwardly beyond the anchor pieces.

6 Claims, 6 Drawing Sheets

FEED ROLLS WITH REPLACEABLE FLUTE ELEMENTS

CROSS-REFERENCE TO RELATED APPLICATION

This application is a continuation of pending U.S. patent application Ser. No. 09/656,500, filed Sep. 7, 2000 now U.S. Pat. No. 6,253,813.

TECHNICAL FIELD

The present invention relates to powered feed rolls of the type used, for example, in feeding and discharging logs to and from debarkers.

BACKGROUND OF THE INVENTION

Commonly upper and lower spaced pairs of driven fluted rolls are used in conjunction with debarkers at the infeed and outfeed. The flutes on the rolls are arranged and shaped to provide a cradle for the logs and to grip and propel the logs forward responsive to powered rotation of the rolls. This is accomplished by having sets of right and left complementing flutes meeting at the center of each roll such that the ends of each flute are displaced circumferentially of the roll from the inner end and by gradually narrowing the height (width) of the complementing flutes along approximately the inner half of their length so that when viewed in elevation the complementing flutes have a generally "V" configuration. This central portion of the flutes normally provides most of the support and traction for advancing the log and is commonly provided with a serrated configuration to better grip the log. Accordingly, the central flute portion is subject to most of the wear and must be replaced from time to time. However, to accomplish this repair the roll must be removed in order for the worn flutes to be removed. The latter is relatively difficult task because the flutes are welded to the roll.

SUMMARY OF THE INVENTION

The present invention aims to greatly ease the repair operation for worn flutes. This has been accomplished by providing easily replaceable flute inserts which are bolted in position to anchoring elements welded to the roll and doing so in a manner whereby the bolts are not subjected to undue shear loads during operation. To avoid overloading the bolts, the flute inserts have part of the length of their inner edge bearing directly against the outer surface of the roll. To do this, the inserts have a central cutout portion along their roll engaging edge to accommodate a welding bead extending part way along the adjacent edge portion of the related anchoring element. The opposite edge portion of the anchoring element has a welding bead therealong for its entire length. The described arrangement adequately fixes the anchoring elements to the roll while permitting the flute inserts to be bolted to the anchoring elements in a position butting against a side face of the anchoring elements and seating against the roll. This arrangement makes repair of the rolls easy to perform without removing the rolls.

DETAILED DESCRIPTION OF THE INVENTION

Figure 1:
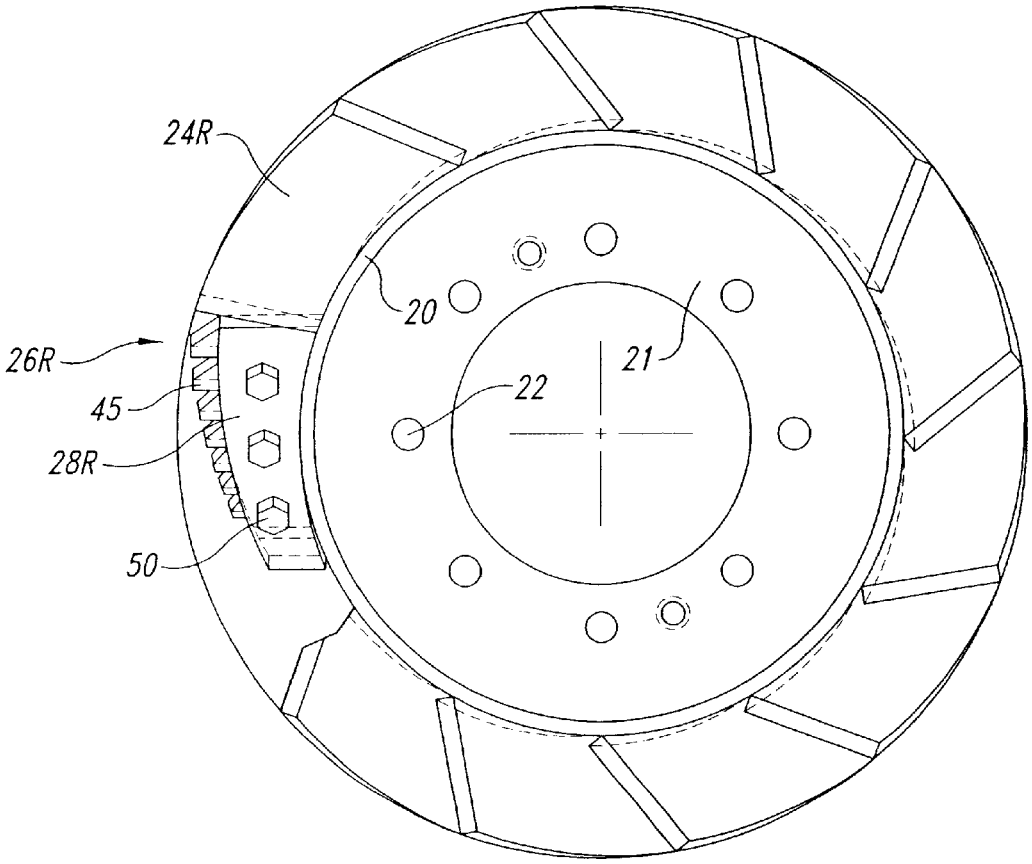
FIG. 1 is an end view of a feed roll incorporating the present invention and partly broken away.

Referring to the drawings, it is seen that the feed roll of the invention has a cylindrical body 20 which may consist of a length of steel pipe. An annular flange 21 is welded in place at the inside of the pipe at its longitudinal center, and has a set of holes 22 to receive bolts for securing a hub in place. The hub in turn receives a drive assembly projecting into one end of the feed roll. This is a standard drive arrangement for debarker feed rolls. Also standard has been providing the outer surface of the feed rolls with traction flutes. In accordance with the present invention, the flutes are provided by complementing right and left sets of fixed outer flutes 24R–24L together with replaceable inner flute insert elements 26R–26L which are bolted to fixed anchor pieces 28R–28L. In the illustrated example, the roll has 12 flutes in each right and left set which are equally spaced apart by 30°.

Figure 9:
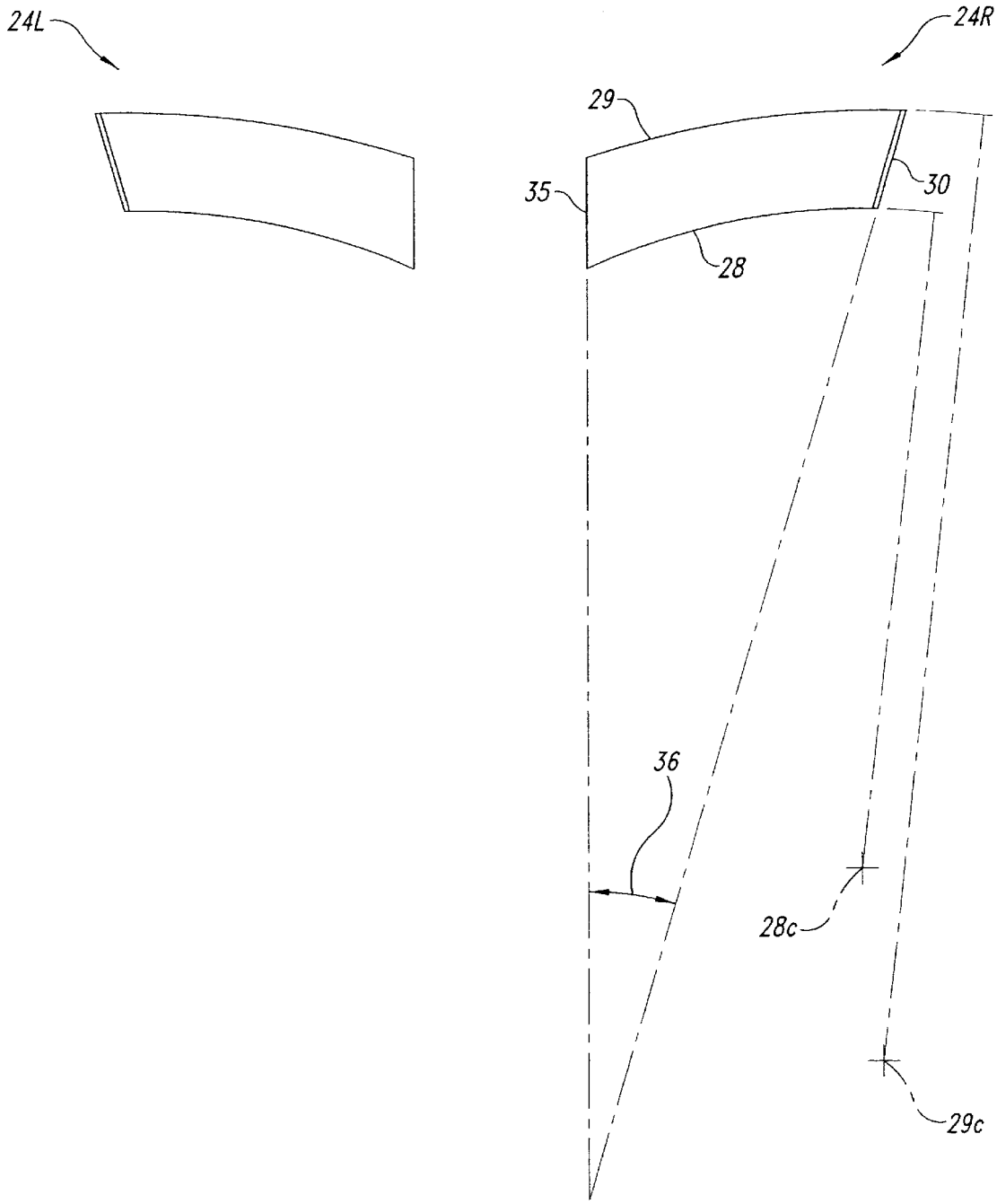
FIG. 9 is a side view of left and right outer flute pieces.

As shown in FIG. 9, the outer flutes 24R–24L are mirror images of one another and have inner and outer arcuate edges 28, 29 having different centers as well as different radii. For example, when the pipe 20 has an outside diameter of 14 inches and a length of 24 inches, suitable radii and respective centers 28C–29C are indicated to scale in FIG. 9. The outer ends 30 arc preferably beveled at about 13°. The described outer flutes are positioned so that their inner and outer ends are displaced with respect to one another circumferentially of the roll as seen, for example, in FIG. 1, and are welded in position.

Figure 8:
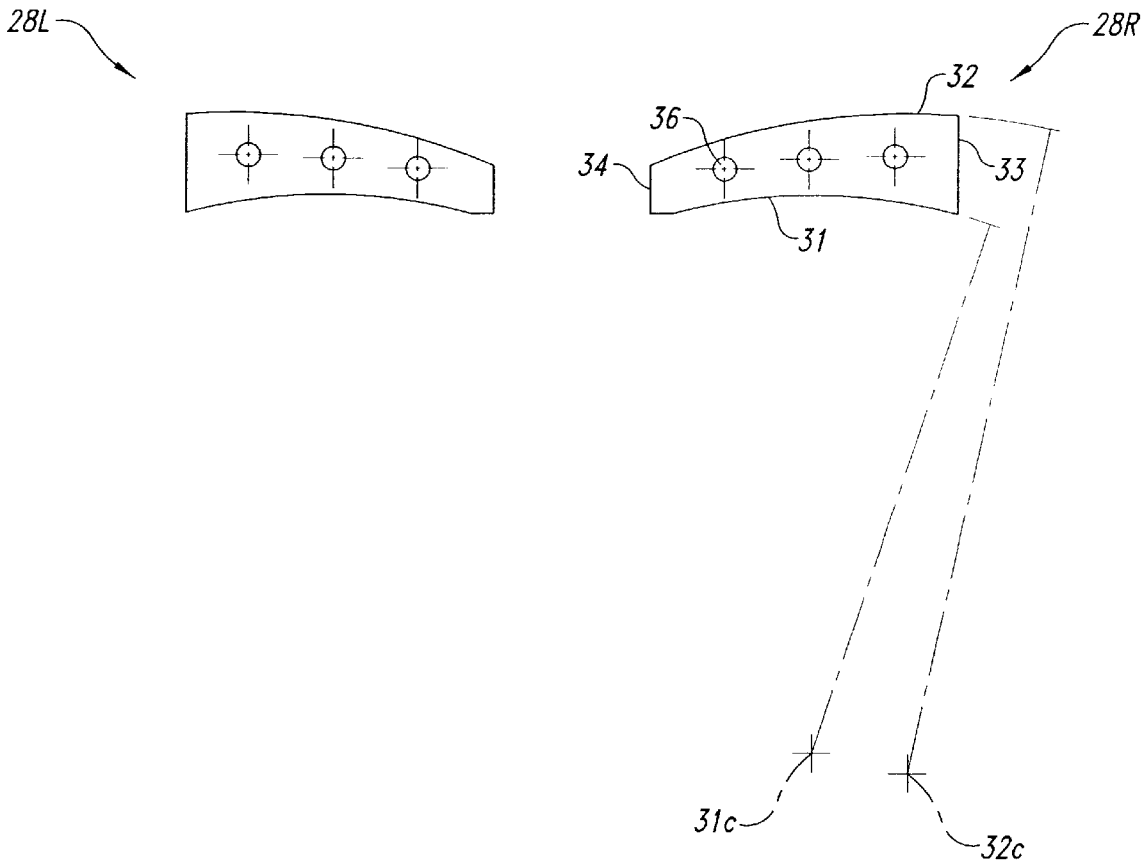
FIG. 8 is a side view of left and right anchor pieces.

Referring to FIG. 8, the anchor pieces 28R–28L on the right and left of the longitudinal center of the roll are shown, these being mirror images of one another. The inner and outer longitudinal edges 31–32 of the anchor pieces are arcuate and have different centers 31C–32C with radial dimensions scaled by way of example to correspond with those indicated for the example of outer flutes 24R–24L. It will be noted that the anchor pieces taper from their outer ends 33 to their inner ends 34. These ends 33–34 may be parallel to one another whereas in the instance of the outer flukes 24R–24L the outer beveled ends 30 are on lines which preferably intersect line extensions of the inner ends 35 by an acute angle 36 indicated in FIG. 9. The anchor pieces 28R–28L are each provided with three holes 36 which are preferably centered between the inner and outer edges 31–32 and are substantially evenly spaced lengthwise of the anchor piece.

Figure 2:
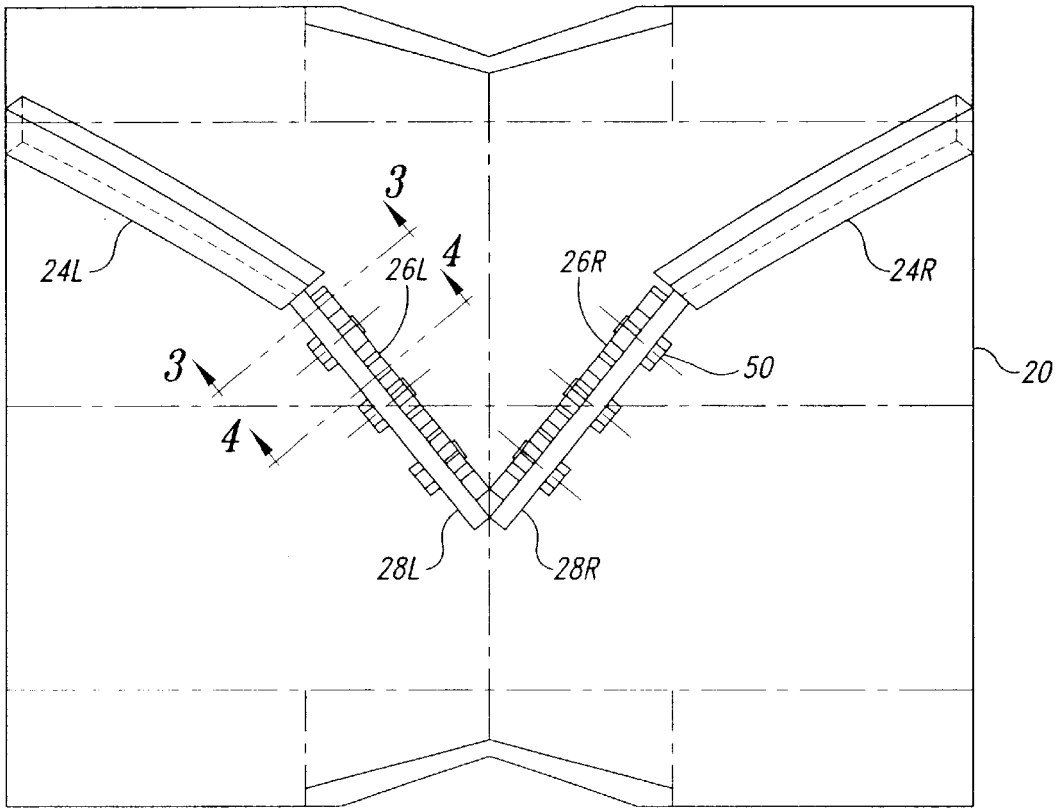
FIG. 2 is a plan view of a feed roll illustrating a set of flute elements.
Figure 3:
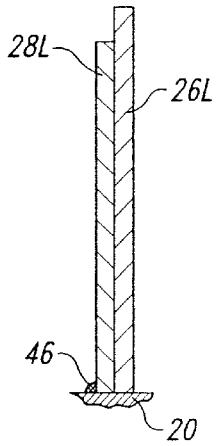
FIGS. 3 and 4 are detail sectional views taken as indicated by lines 3—3 and 4—4 in FIG. 2.

Continuing to the replaceable insert elements 26R–26L, these too can be mirror images of one another and are shaped to butt face to face against the respective anchor pieces 28R–28L, i.e., the trailing face of the insert elements abuts the leading face of the anchor pieces as viewed in FIG. 2. The longitudinal edges of the insert elements are generally arcuate. The inner longitudinal edge has a central cutout 40 with a uniform depth of about 0.5 inches from two longitudinal edge portions 41*a*–41*b* at the opposite ends of the cutout 40. Like the anchor pieces 28R–28L, the insert elements 26R–26L taper in width from outer ends 42 to narrower inner ends 43. Three threaded holes 44 are provided to register with the holes 36 in the anchor pieces. The threads in the holes 44 in the insert elements 26R–26L are tapped from the trailing faces of the insert elements. Along its outer arcuate longitudinal edge, each insert element is preferably formed with teeth 45 which may have their leading and trailing edges beveled. The teeth are preferably progressively larger in depth and width from the inner end of 43 of each insert element to the wider outer end 42.

Figure 4:
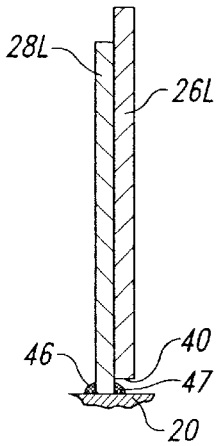
Figure 5:
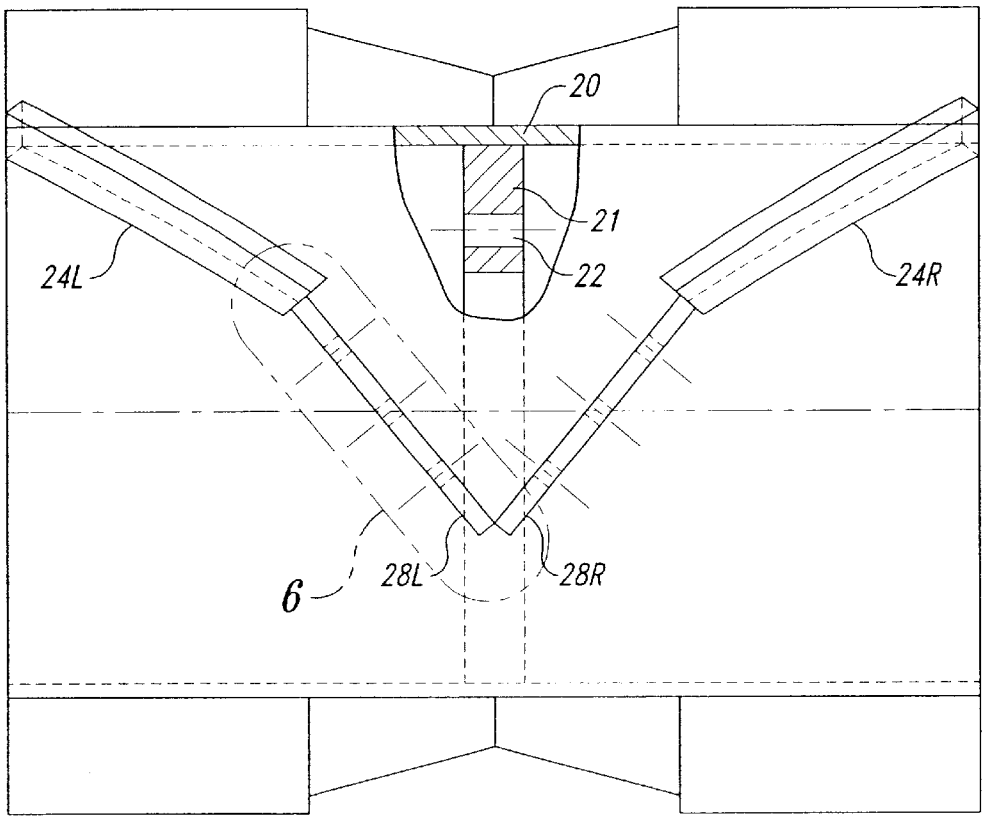
FIG. 5 is a view corresponding to claim 2 with the replaceable insert elements removed and part of the outer face of the roll broken away.
Figure 6:
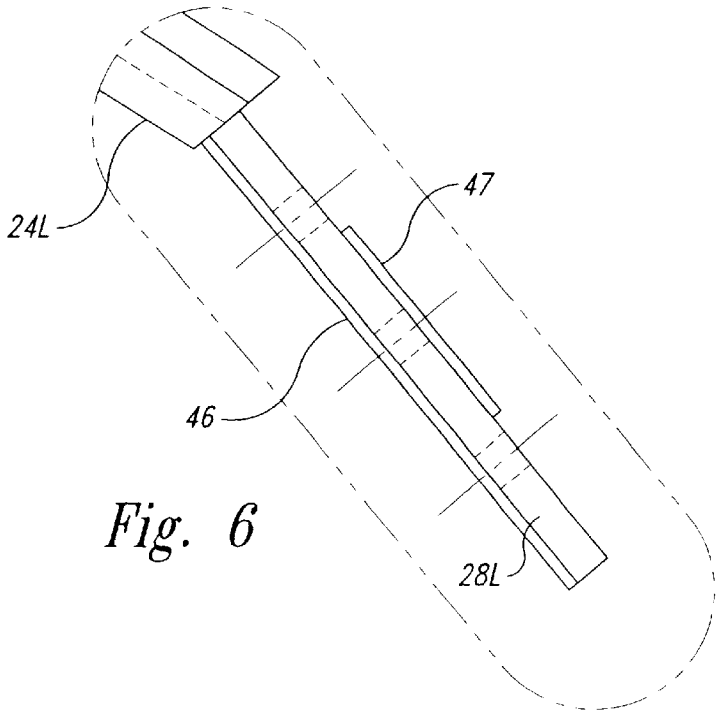
FIG. 6 is an enlarged top plan view of an anchor piece taken as shown in FIG. 5 by numeral 6 and with welding beads shown.
Figure 7:
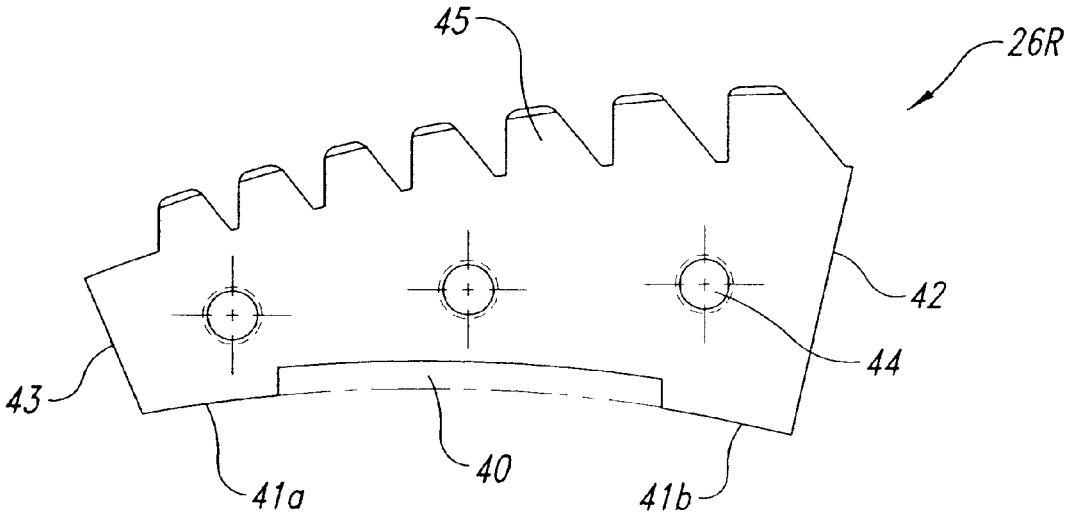
FIG. 7 is a side view of an insert element to a scale enlarged relative to FIGS. 8 and 9.

Referring to FIG. 6, the anchor pieces 28R–28L are each welded in position to the pipe 20 by two welding beads 46–47, one on each side. The bead 46 preferably extends the full length of the respective anchor piece at the trailing side whereas the other bead 47 only extends along a central portion of the anchor piece at the leading side. With this welding pattern, the insert elements 26R–26L can abut the leading face of the anchor pieces and have their bottom longitudinal edge portions 41*a*–41*b* in engagement with the outer face of the pipe 20 while the shorter welding bead 47 occupies the central cutout 40 as seen in FIG. 4. Bolts 50 are inserted through the holes 36 in the anchor pieces and are screwed into the threaded holes 44 in the insert elements until the bolt heads bear snugly against the trailing faces of the anchor pieces. When this is accomplished, the bolts protrude slightly beyond the leading faces of the insert elements. Loctite is initially applied to the bolts and the bolts are torqued when the insert elements are seated snugly against the rim of the pipe 20. This seating relieves the bolts from shearing loads. It will be noted that the anchor elements are so positioned relative to the outer flutes 24R–24L that the anchor pieces are generally aligned with the inner ends of the outer flutes. The insert elements are made sufficiently wider than the anchor pieces to expose the teeth radially outward beyond the outer longitudinal edge 32 of the related anchor piece.

It is apparent that with the described arrangement, the insert elements 26R–26L can be speedily replaced without removing the rolls merely by removing the bolts 50 and mounting replacement insert elements as before.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A replaceable flute insert element for use on a fluted roll having an anchor element welded in position and having a set of bolt holes therethrough, said insert element comprising:

an elongated plate body which has an inner longitudinal edge and an outer longitudinal edge, the inner longitudinal edge being shaped to conform with a corresponding length along an external surface of the fluted roll;

said inner longitudinal edge having a central elongated recess for accommodating a welding bead extending part way along said anchor element, and said outer longitudinal edge being formed with traction elements; and said plate body having a plurality of bolt holes therethrough for registering with said set.

2. A replaceable flute element according to claim 1 in which said inner longitudinal edge has curved sections extending between the ends of said recess and said ends of the plate body.

3. A replaceable flute element according to claim 1 in which said traction elements comprise teeth which are progressively longer from said narrower end to said wider end.

4. A replaceable flute element according to claim 1 wherein the inner longitudinal edge is curved.

5. A replaceable flute element according to claim 1 wherein the outer longitudinal edge is curved.

6. A replaceable flute element according to claim 1 wherein the inner and outer longitudinal edges are curved.

* * * * *